US008380523B2

(12) United States Patent
Kim et al.

(10) Patent No.: US 8,380,523 B2
(45) Date of Patent: Feb. 19, 2013

(54) METHOD AND AN APPARATUS FOR PROCESSING AN AUDIO SIGNAL

(75) Inventors: Dong Soo Kim, Seoul (KR); Sung Yong Yoon, Seoul (KR); Hyun Kook Lee, Seoul (KR); Jae Hyun Lim, Seoul (KR)

(73) Assignee: LG Electronics Inc., Seoul (KR)

( * ) Notice: Subject to any disclaimer, the term of this patent is extended or adjusted under 35 U.S.C. 154(b) by 896 days.

(21) Appl. No.: 12/498,676

(22) Filed: Jul. 7, 2009

(65) Prior Publication Data

US 2010/0070285 A1 Mar. 18, 2010

Related U.S. Application Data

(60) Provisional application No. 61/078,763, filed on Jul. 7, 2008.

(51) Int. Cl.
*G10L 21/00* (2006.01)

(52) U.S. Cl. .... 704/500; 704/219; 704/229; 375/240.23

(58) Field of Classification Search ..... 704/219, 704/229, 500; 375/240.23
See application file for complete search history.

(56) References Cited

U.S. PATENT DOCUMENTS 5,978,762 A * 11/1999 Smyth et al. ..... 704/229
6,300,888 B1 10/2001 Chen et al.
6,487,535 B1 * 11/2002 Smyth et al. ..... 704/500
6,735,567 B2 * 5/2004 Gao et al. ..... 704/258
2003/0009325 A1 1/2003 Kirchherr et al.
2006/0089832 A1 4/2006 Ojanpera
2010/0286991 A1 * 11/2010 Hedelin et al. ..... 704/500

FOREIGN PATENT DOCUMENTS

KR 10-2008-0050442 A 6/2008

* cited by examiner

*Primary Examiner* — Daniel D Abebe
(74) *Attorney, Agent, or Firm* — Birch, Stewart, Kolasch & Birch, LLP

(57) ABSTRACT

The present invention includes receiving a plurality of frame data including first frame data and second frame data encoded by at least one coding schemes, obtaining first flag information indicating whether the first frame data and the second frame data are encoded by frequency domain transform coding scheme, respectively, decoding the first frame data by frequency domain transform coding scheme based on the first flag information when the first frame data is encoded by frequency domain transform coding scheme, obtaining second flag information indicating whether subframe data is encoded by time domain transform coding scheme or time-frequency domain coding scheme when the second frame data is not encoded by frequency domain transform coding scheme, the at least two subframe data being included in the second frame data, decoding the subframe data by time domain transform coding scheme or time-frequency domain transform coding scheme based on the second flag information, and compensating for discontinuity existing between the first frame data decoded by frequency domain transform coding scheme and the subframe data decoded by time domain transform coding scheme, wherein the time-frequency domain coding scheme is time domain coding scheme including frequency domain transform.

18 Claims, 12 Drawing Sheets

(A)

(B)

METHOD AND AN APPARATUS FOR PROCESSING AN AUDIO SIGNAL

This application claims the benefit of U.S. Provisional Application No. 61/078,763, filed on Jul. 7, 2008, which is hereby incorporated by reference as if fully set forth herein.

BACKGROUND OF THE INVENTION

1. Field of the Invention

The present invention relates to an apparatus for encoding/decoding an audio signal and method thereof. Although the present invention is suitable for a wide scope of applications, it is particularly suitable for encoding or decoding audio signals.

2. Discussion of the Related Art

Generally, audio coding schemes can be mainly classified into a perceptual audio coder optimized for music and a linear prediction based coder optimized for speech.

However, an audio coding scheme according to a related art fails to provide consistent performance on a mixed signal constructed with different kinds of audio signals or a mixed signal constructed with a speech signal and a music signal, while having good performance on an optimized audio signal (e.g., a speech signal, a music signal, etc.) according to a characteristic of the audio signal.

SUMMARY OF THE INVENTION

Accordingly, the present invention is directed to an apparatus for encoding/decoding an audio signal and method thereof that substantially obviate one or more of the problems due to limitations and disadvantages of the related art.

An object of the present invention is to provide an apparatus for encoding/decoding an audio signal and method thereof, by which an encoding/decoding scheme is appropriately switched according to a characteristic of an inputted signal in an audio signal in which a speech characteristic and a non-speech characteristic are mixed.

Another object of the present invention is to provide an apparatus for encoding/decoding an audio signal and method thereof, by which discontinuity is prevented from occurring in switching an encoding/decoding scheme of a mixed signal.

Accordingly, the present invention provides the following effects and/or advantages.

First of all, in an audio signal having audio and speech characteristics mixed therein, the present invention appropriately switching encoding and decoding schemes to be suitable for a characteristic of an inputted signal, thereby securing a uniform quality of to sound without being affected by a characteristic of a sound source.

Secondly, the present invention prevents the occurrence of discontinuity that may generated in switching of encoding and decoding schemes of a mixed signal, thereby securing a high quality of sound.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, a method of processing an audio signal according to the present invention includes the steps of receiving a plurality of frame data including first frame data and second frame data encoded by at least one coding schemes, obtaining first flag information indicating whether the first frame data and the second frame data are encoded by frequency domain transform coding scheme, respectively, decoding the first frame data by frequency domain transform coding scheme based on the first flag information when the first frame data is encoded by frequency domain transform coding scheme, obtaining second flag information indicating whether subframe data is encoded by time domain transform coding scheme or time-frequency domain coding scheme when the second frame data is not encoded by frequency domain transform coding scheme, the at least two subframe data being included in the second frame data, decoding the subframe data by time domain transform coding scheme or time-frequency domain transform coding scheme based on the second flag information, and compensating for discontinuity existing between the first frame data decoded by frequency domain transform coding scheme and the subframe data decoded by time domain transform coding scheme, wherein the time-frequency domain coding scheme is time domain coding scheme including frequency domain transform.

More preferably, the method further includes the step of compensating for discontinuity existing between the subframe data decoded by time domain transform coding scheme and the subframe data decoded by time-frequency domain transform coding scheme.

Preferably, the compensating step is performed using at least one selected from the group consisting of smoothing, ZIR (Zero Input Response) and reverberation filter.

Preferably, the frame data and the subframe data decoding steps comprise the step of compensating for a delay between the frame data and between the subframe data.

To further achieve these and other advantages and in accordance with the purpose of the present invention, an apparatus for processing an audio signal includes a decoding unit (a) receiving a plurality of frame data including first frame data and second frame data encoded by at least one coding schemes, (b) obtaining first flag information indicating whether the first frame data and the second frame data are encoded by frequency domain transform coding scheme, respectively, (c) decoding the first frame data by frequency domain transform coding scheme based on the first flag information when the first frame data is encoded by frequency domain transform coding scheme, (d) obtaining second flag information indicating whether subframe data is encoded by time domain transform coding scheme or time-frequency domain coding scheme when the second frame data is not encoded by frequency domain transform coding scheme, the at least two subframe data being included in the second frame data and (e) decoding the subframe data by time domain transform coding scheme or time-frequency domain transform coding scheme based on the second flag information, and a compensating unit compensating for discontinuity existing between the first frame data decoded by frequency domain transform coding scheme and the subframe data decoded by time domain transform coding scheme, wherein the time-frequency domain coding scheme is time domain coding scheme including frequency domain transform.

More preferably, the compensating unit compensates for discontinuity existing between the subframe data decoded by time domain transform coding scheme and the subframe data decoded by time-frequency domain transform coding scheme.

Preferably, the compensating step is performed using at least one selected from the group consisting of smoothing, ZIR and reverberation filter.

Preferably, the frame data and the subframe data decoding steps comprise the step of compensating for a delay between the frame data and between the subframe data.

To further achieve these and other advantages and in accordance with the purpose of the present invention, a computer-readable storage medium includes digital audio data stored therein. The digital audio data includes a plurality of frame data including first frame data and second frame data encoded by at least one coding schemes, first flag information indicating whether each of the first frame data and the second frame data is encoded by frequency domain transform coding scheme, and second flag information indicating whether subframe data is encoded by time domain transform coding scheme or time-frequency domain coding scheme when the second frame data is not encoded by frequency domain transform coding scheme, the at least two subframe data being included in the second frame data, wherein the time-frequency domain coding scheme is time domain coding scheme including frequency domain transform, and wherein the first frame data is decoded by frequency domain transform coding scheme based on the first flag information when the first frame data is encoded by frequency domain transform coding scheme, and the subframe data is decoded by time domain transform coding scheme or time-frequency domain transform coding scheme based on the second flag information, and the digital audio data is compensated for discontinuity existing between the first frame data decoded by frequency domain transform coding scheme and the subframe data decoded by time domain transform coding scheme.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE INVENTION

Reference will now be made in detail to the preferred embodiments of the present invention, examples of which are illustrated in the accompanying drawings. First of all, terminologies or words used in this specification and claims are not construed as limited to the general or dictionary meanings and should be construed as the meanings and concepts matching the technical idea of the present invention based on the principle that an inventor is able to appropriately define the concepts of the terminologies to describe the inventor's invention in best way. The embodiment disclosed in this disclosure and configurations shown in the accompanying drawings are just one preferred embodiment and do not represent all technical idea of the present invention. Therefore, it is understood that the present invention covers the modifications and variations of this invention provided they come within the scope of the appended claims and their equivalents at the timing point of filing this application.

The following terminologies in the present invention can be construed based on the following criteria and other terminologies failing to be explained can be construed according to the following purposes. First of all, it is understood that the concept 'coding' in the present invention includes both encoding and decoding. Secondly, 'information' in this disclosure is the terminology that generally includes values, parameters, coefficients, elements and the like and its meaning can be construed as different occasionally, by which the present invention is non-limited.

In this disclosure, an audio signal is conceptionally discriminated from a video signal and designates all kinds of signals that can be auditorily identified. In a narrow sense, the audio signal means a signal having none or small quantity of speech characteristics. Audio signal of the present invention should be construed in a broad sense. And, the audio signal of the present invention can be understood as a narrow-sense audio signal in case of being used by being discriminated from a speech signal.

Meanwhile, a frame indicates a unit for encoding or decoding an audio signal and is non-limited by a specific number of samples or a specific time.

An apparatus for processing an audio signal and method thereof according to the present invention may include an audio signal decoding apparatus including a compensating unit for compensating for discontinuity, which may occur in audio coding scheme switching, and method thereof and can further include an audio signal decoder and method thereof having the above apparatus and method applied thereto. In the following description, an apparatus for switching an audio coding scheme and method thereof, discontinuity and compensation thereof in switching, and an audio signal decoding apparatus having the switching apparatus and compensating unit applied thereto and method thereof are explained.

Figure 1:
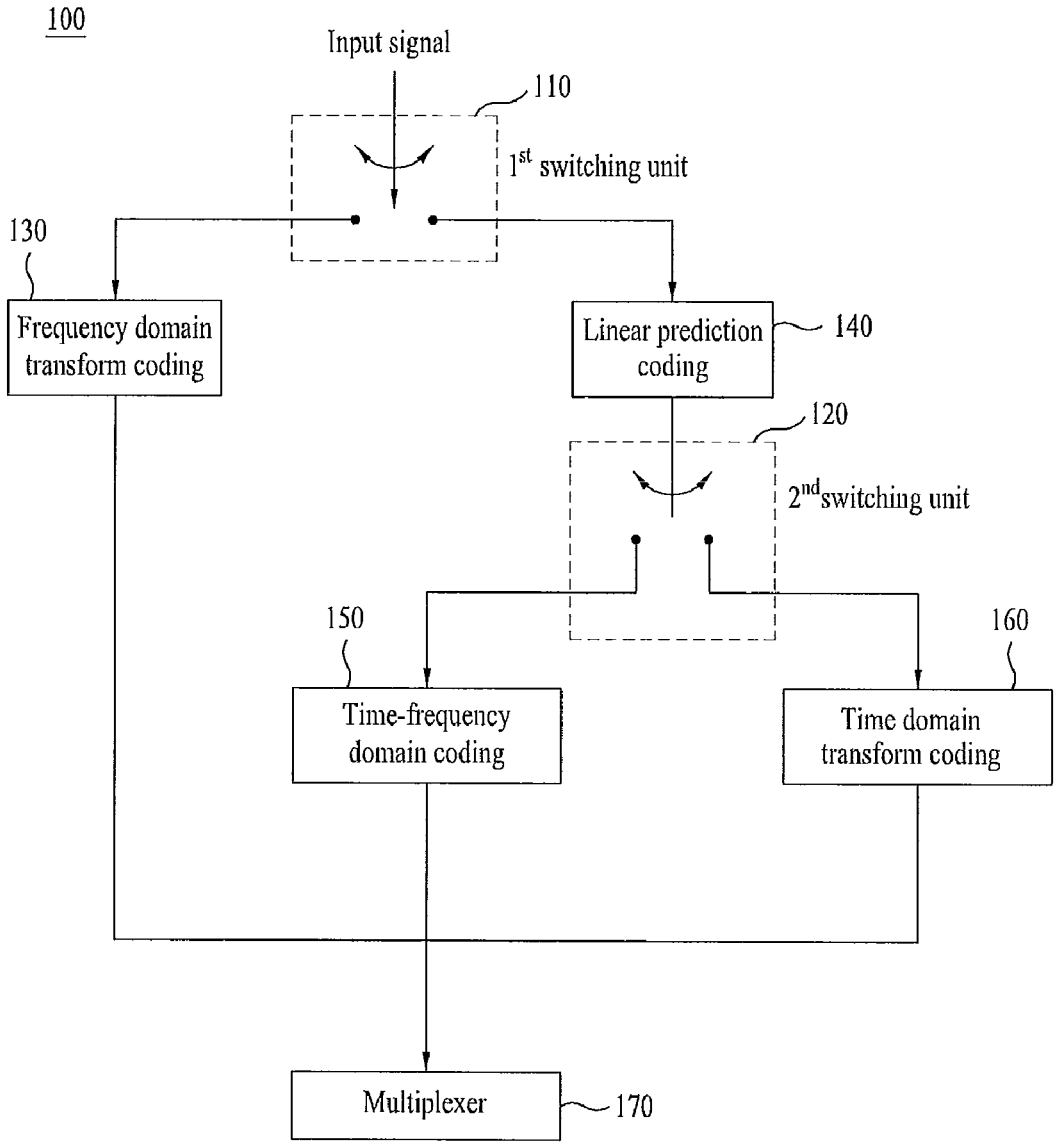
FIG. 1 is a block diagram of an audio signal processing apparatus including an audio coding scheme switching unit according to an embodiment of the present invention.

FIG. 1 is a block diagram of an audio signal processing apparatus including an audio coding scheme switching unit according to an embodiment of the present invention.

Referring to FIG. 1, an audio signal processing apparatus 100 can include a first switching unit 110 and a second switching unit 120. A process for an audio coding scheme switching unit to switch an audio signal is explained with reference to FIG. 1 as follows.

First of all, the first switching unit 110 obtains a characteristic of an input signal and then determines an audio coding scheme in a manner of determining whether to perform a frequency domain transform coding on an input signal frame. In the frequency domain convert coding 130, if a specific frame or segment of the input signal has a large audio characteristic, the input signal is coded by the frequency domain coding, e.g., a modified discrete transform (MDCT) encoder. In this case, the MDCT encoder may follows the AAC (advanced audio coding) standard or the HE-AAC (high efficiency advanced audio coding) standard, by which the present invention is non-limited.

In the second switching unit 120, a frame of the input signal is not encoded by the frequency domain transform coding 130. The second switching unit 120 determines whether subframe data is encoded by time domain transform coding scheme or time-frequency domain coding scheme, the at least two subframe data being included in the second frame data. In this case, the time-frequency domain coding scheme is time domain transform coding scheme including frequency domain transform, the time-frequency domain coding scheme may include TCX (transform coded excitation) coding, by which the present invention is non-limited. The time-frequency domain transform coding scheme 150 may include e.g., ACELP (algebraic code excited linear prediction) coding, by which the present invention is non-limited.

The audio coding scheme switching unit 110/120 of the audio signal processing apparatus according to the embodiment of the present invention can further include a signal assorting unit (sound activity detector: not shown in the drawing) that assorts an inputted audio signal. Thus, the object of assorting the inputted audio signal is to raise coding efficiency according to a characteristic of the inputted audio signal in a manner of performing coding by a coding scheme optimized per audio signal type and transferring information on the coding scheme to a decoder by having the coding scheme information contained as a bitstream within a finally coded audio signal.

Figure 2:
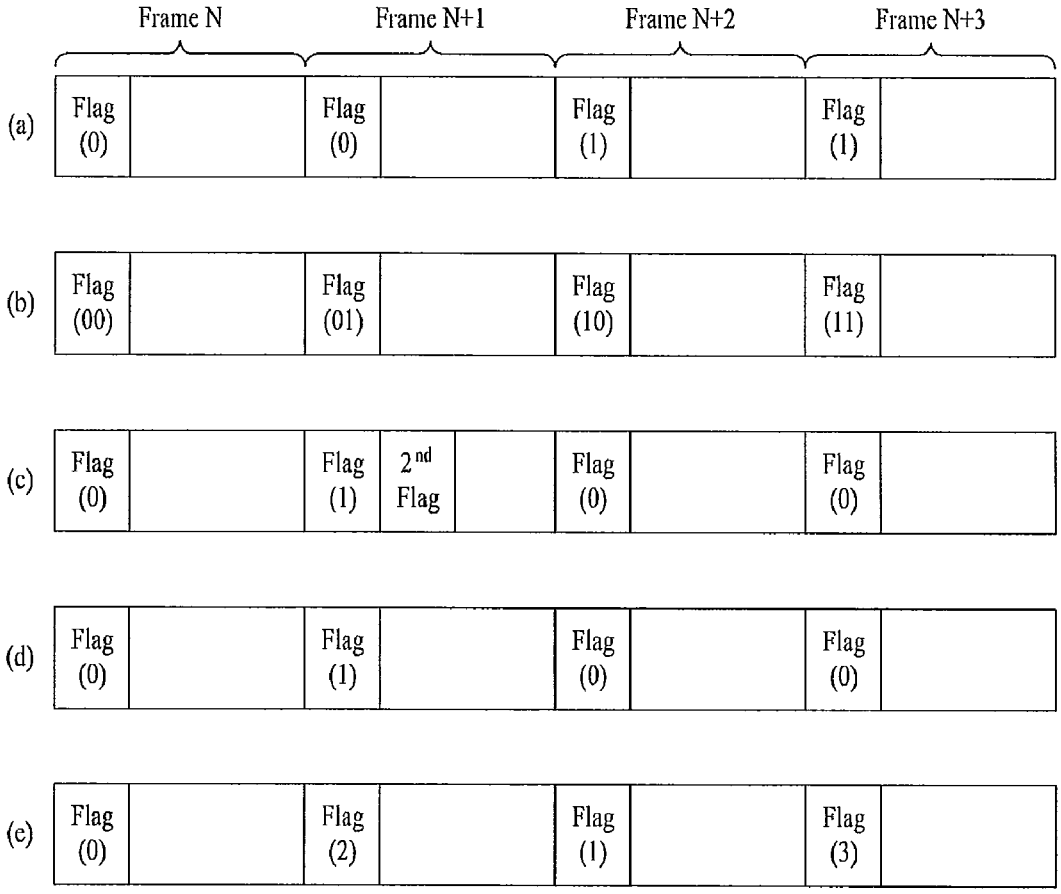
FIG. 2 is a diagram for a method of representing flag information indicating coding scheme information.

FIG. 2 is a diagram for a method of representing flag information indicating coding scheme information. In FIG. 2, FIG. 2*a*, FIG. 2*d* and FIG. 2*e* show examples for representing flag information in case that two kinds of switched codec types exist. And, FIG. 2*b* and FIG. 2*c* show examples for representing flag information in case that three kinds of switched codec types exist. This disclosure of the present invention describes the cases of two and three kinds of codec types, by which the present invention is non-limited.

Referring to FIG. 2*a*, in case that there are two kinds of switched codec types, a flag is able to represent the type of a codec used for the coding of a corresponding frame only. In particular, flag '0 and flag '1' can be allocated to the two kinds of codecs, respectively.

Referring to FIG. 2*b*, in case that there are three kinds of switched codec types, flag information can be represented in the same manner of the former case that there are two kinds of switched codec types. In particular, a flag is allocated to each of the three kinds of codecs, respectively. Yet, since 1-bit flag information is not available for the case that there are three kinds of codec types, 2-bit flag information such as '00', '01', '10' and '11' are available to be allocated.

Referring to FIG. 2*c*, if a flag of an (N+1)th frame is set to '1', it means that a codec used for a current frame is different from that used for a previous frame. In this case, second flag information is able to indicate which codec becomes different. Thus, in the method explained with reference to FIG. 2*b*, a type of codec is represented for each frame. Yet, in the method explained with reference to FIG. 2*c*, it is advantageous in that the number of bits can be reduced by representing which coded becomes different only if a codec of a current frame becomes different.

Referring to FIG. 2*d*, if a flag of an Nth frame is set to '0', it means that a codec used for a current frame is equal to that used for a previous frame. If a flag of an (N+1)th frame is set to '1', it means that the same codec used for a previous frame is still used for a current frame but a type of a codec will be changed in a next frame, i.e., switching will take place in a next frame. If a flag of an (N+2)th frame is set to '0', it means which codec is switched. In case that there are two kinds of switched codec types, it can be represented as '0' or '1'. If there are three kinds of codec types, a switched codec corresponds to one of the two and a corresponding codec can be represented as '0' or '1'. In case of the (N+2)th frame, it indicates a case that a flag is set to '0' like the case of the Nth frame. Therefore, it can be observed that the same codec used for the previous frame is used as well.

Referring to FIG. 2*e*, in case that there are tow kinds of witched codec types, a flag '0' or '1' indicates each codec. And a flag '2' or '3' indicates a last frame right before switching.

In the method explained with reference to FIG. 2*d*, even if a same flag value, it can be interpreted as different according to information on a previous frame. In particular, if information on a previous frame fails to exist, it is not able to interpret the meaning of a flag value. Hence, this method is usable for a file system but may not be available for a streaming service. Yet, if information on a refresh frame is included in another region of a bitstream, this method may be usable for the streaming service.

Figure 3:
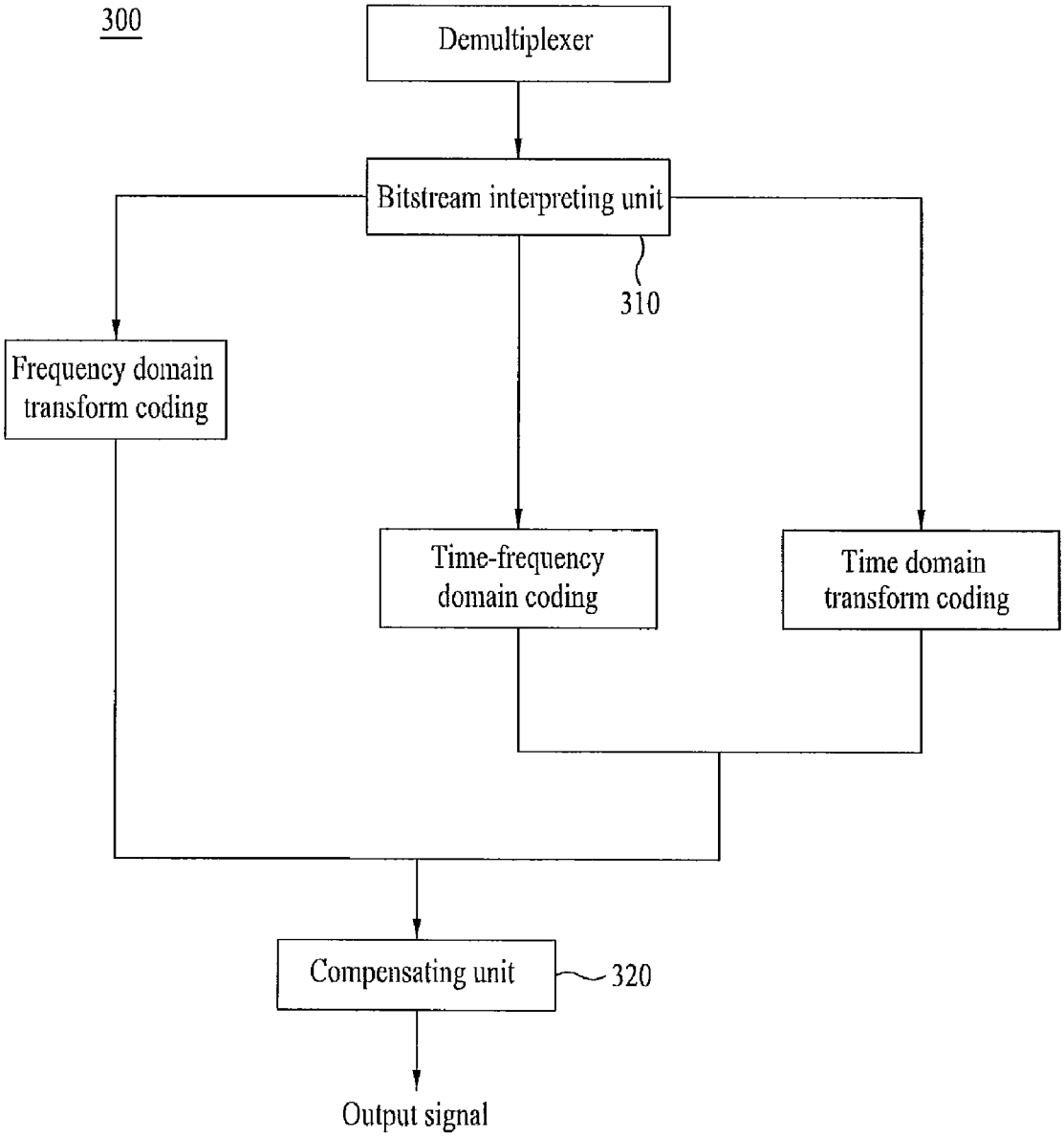
FIG. 3 is a block diagram of an audio signal processing apparatus including a compensating unit according to an embodiment of the present invention.

FIG. 3 is a block diagram of an audio signal processing apparatus including a compensating unit according to an embodiment of the present invention.

Referring to FIG. 3, an audio signal processing apparatus 300 can include a bitstream interpreting unit 310 and a compensating unit 320. The bitstream interpreting unit 310 determines a decoding scheme of a current frame based on flag information included in an inputted frame according to the method explained with reference to FIG. 2. The inputted bitstream is decoded by the determined decoding scheme to generate an output signal.

And, the compensating unit 320 is configured to compensate for discontinuity generated in switching a frequency domain transform coding and a time domain transform coding and will be explained in detail as follows.

Figure 4:
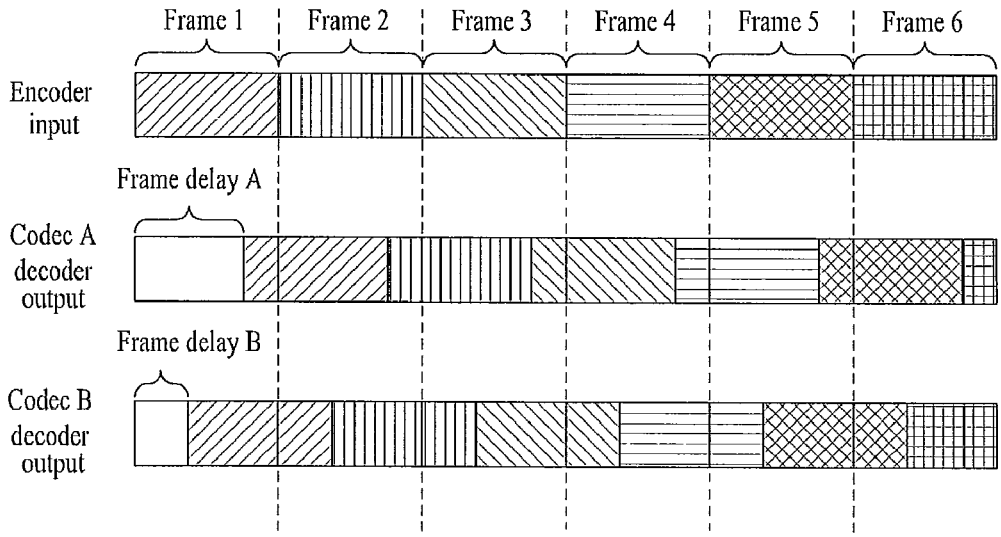
FIG. 4 and FIG. 5 are diagrams for a frame delay (algorithmic delay) generally occurring in codec.
Figure 5:
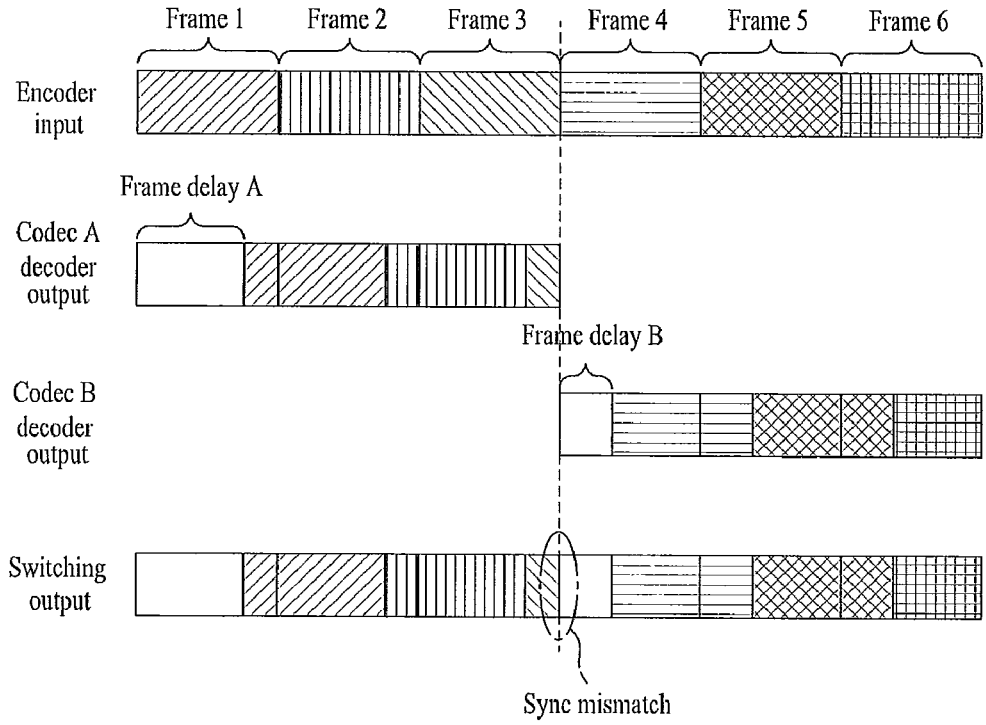

FIG. 4 and FIG. 5 are diagrams for a frame delay (algorithmic delay) generally occurring in codec.

Referring to FIG. 4, a frame delay is generated between a PCM signal inputted to an encoder and an output signal resulting from encoding and decoding the PCM signal. And, a frame delay may differ in size according to a type of codec. Therefore, in switching a coding scheme according to a characteristic of an input signal, as shown in FIG. 1, a sound quality is degraded due to this difference of the frame delay.

In case that an inputted audio signal is generally coded by applying the same coding scheme without considering a characteristic of the inputted audio signal, a size of a frame delay becomes uniform. Hence, even if switching occurs without changing a coding scheme, a sync of an audio signal before switching is mismatched with a sync of the audio signal after the switching, a sound quality may be degraded.

Yet, since the audio apparatus having the present invention applied thereto, as shown in FIG. and FIG. 3, performs the switching using different coding schemes, as mentioned in the above description, the audio signal sync is mismatched before and after the switching to result in the degradation of the sound quality. Therefore, in order to prevent this problem, a process for compensating for a frame delay is mandatory.

Figure 6:
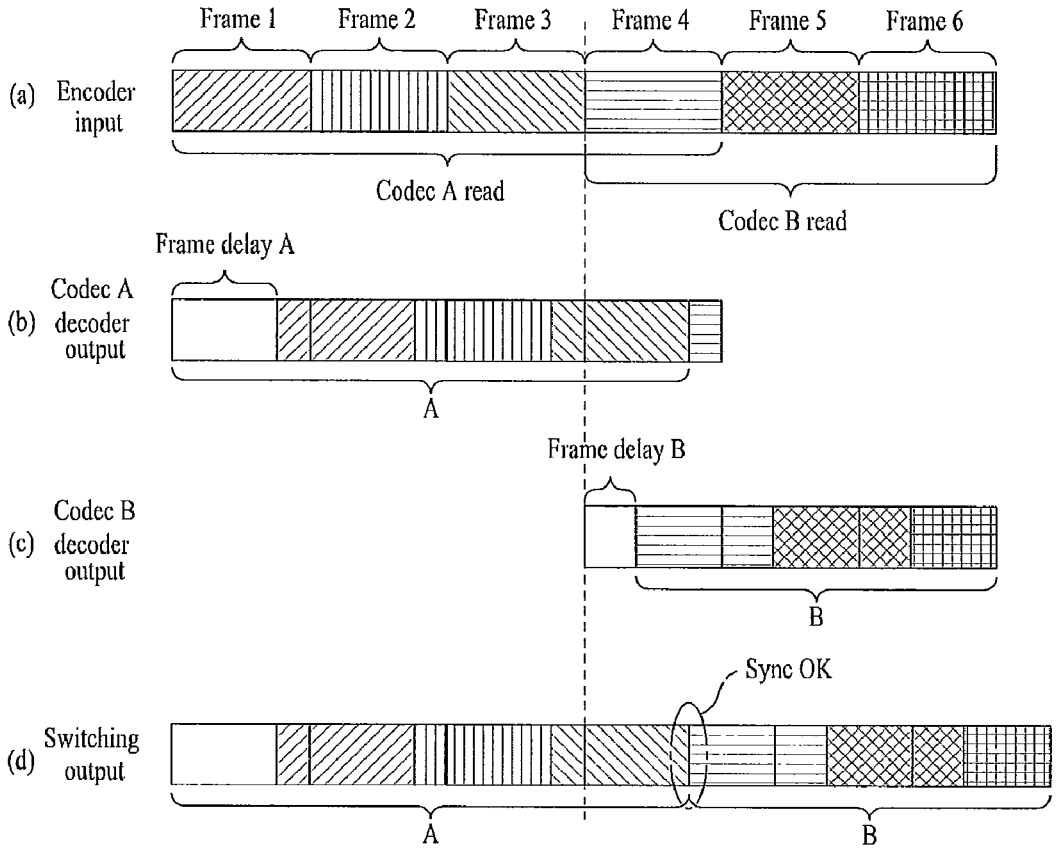
FIG. 6 is a diagram for a method of compensating for a frame delay.

FIG. 6 is a diagram for a method of compensating for a frame delay.

Referring to FIG. 6, a signal outputted via the decoding apparatus 300 is inputted to the encoding apparatus 100. With reference to this signal, in order to configure an output having a codec A applied to frames 1 to 3 and an output having a codec B applied to frames 4 to 6, coding is performed until the frame 4, which is the frame right after the switching, using the codec A [FIG. 6*b*]. Meanwhile, coding is performed for the frames 4 to 6 using the codec B [FIG. 6*c*]. Subsequently, if a portion A of the output signal outputted using the codec A and a portion B of the output signal outputted using the codec B are segmented and then concatenated together, the problem of the sync mismatch in a switching interval is not caused [FIG. 6*d*].

Even if the problem of the frame delay, which may be caused in performing the switching, is amended through the frame delay compensation, as shown in FIG. 6, there may occur a problem that discontinuity still exists in a switching interval of an output signal.

Figure 7:
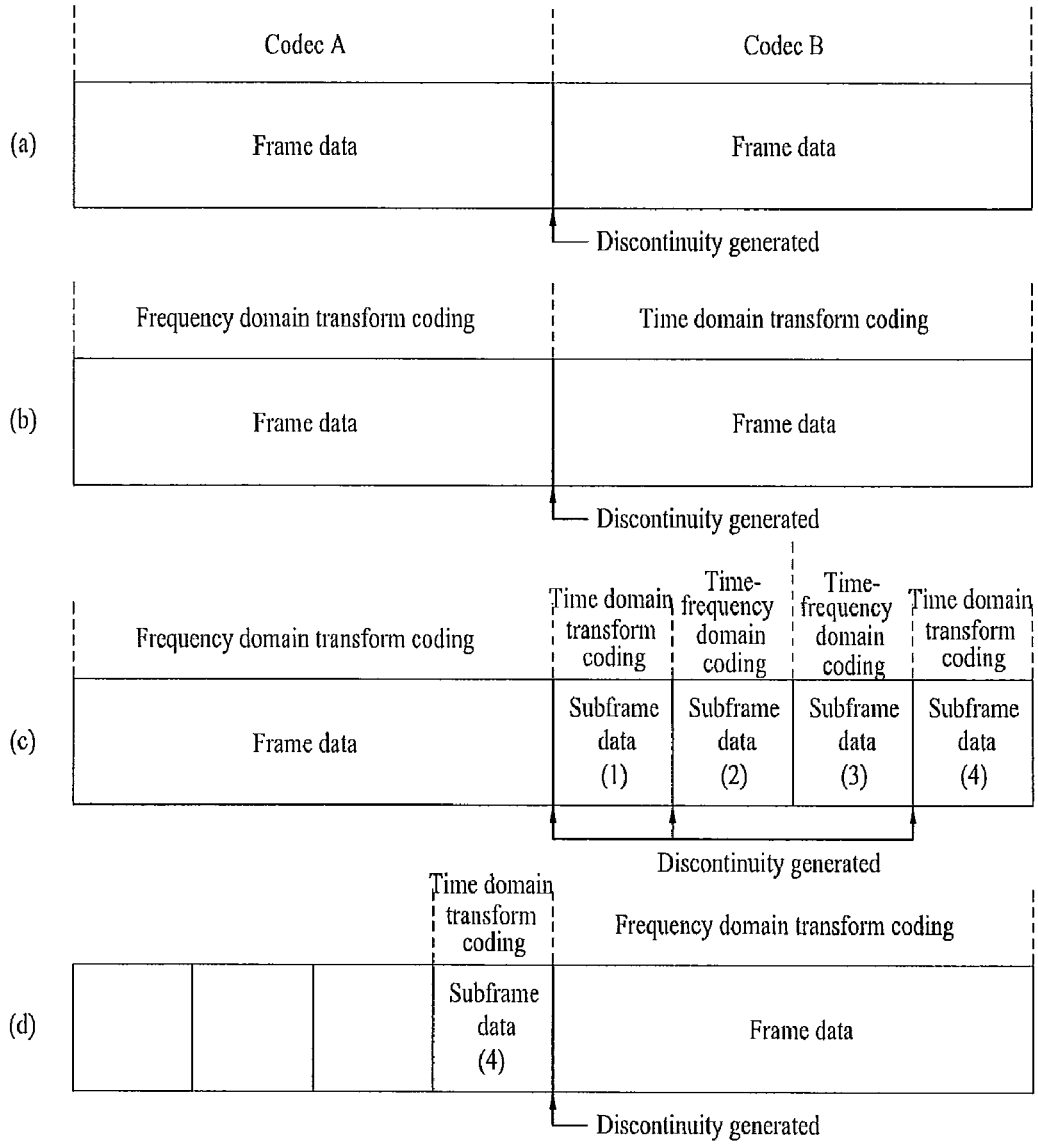
FIG. 7 is a diagram for an example of discontinuity occurrence in switching of a coding scheme according to the present invention.

FIG. 7 is a diagram for an example of discontinuity occurrence in switching of a coding scheme according to the present invention.

FIG. 7*a* shows discontinuity generated from the coding scheme switching from a codec A to a codec B in general. And, FIG. 7*b* shows discontinuity that may be generated in case of a coding scheme switching according to the present invention.

The reason why discontinuity occurs in a switching interval of an output signal is because coding is performed by applying a different coding scheme according to a characteristic of an inputted audio signal. Namely, as mentioned in the foregoing description, if a specific frame or segment of an input signal has a large audio characteristic, the inputted signal is coded by a frequency domain transform coding, i.e., a MDCT encoder. If a specific frame or segment of an input signal has a large speech characteristic, the inputted signal is coded by ACELP coding (time domain transform coding) or such a linear prediction modeling scheme as AMR coding scheme and AMR-WB coding scheme.

Referring to FIG. 7*b*, discontinuity may be generated between output frame data using frequency domain transform coding and output frame data using time domain transform coding. Referring to FIG. 7*c*, discontinuity may be generated between output frame data using frequency domain transform coding and output subframe data using time domain transform coding or between output subframe data using time domain transform coding and output subframe data using time-frequency domain transform coding. Meanwhile, referring to FIG. 7*d*, if time domain transform coding is performed on a subframe constructing a last frame right before switching and if a next frame is a frame using frequency domain transform coding, discontinuity may be generated. Namely, the discontinuity can be generated in case of the switching between a frame and a subframe as well as the inter-subframe switching.

Figure 8:
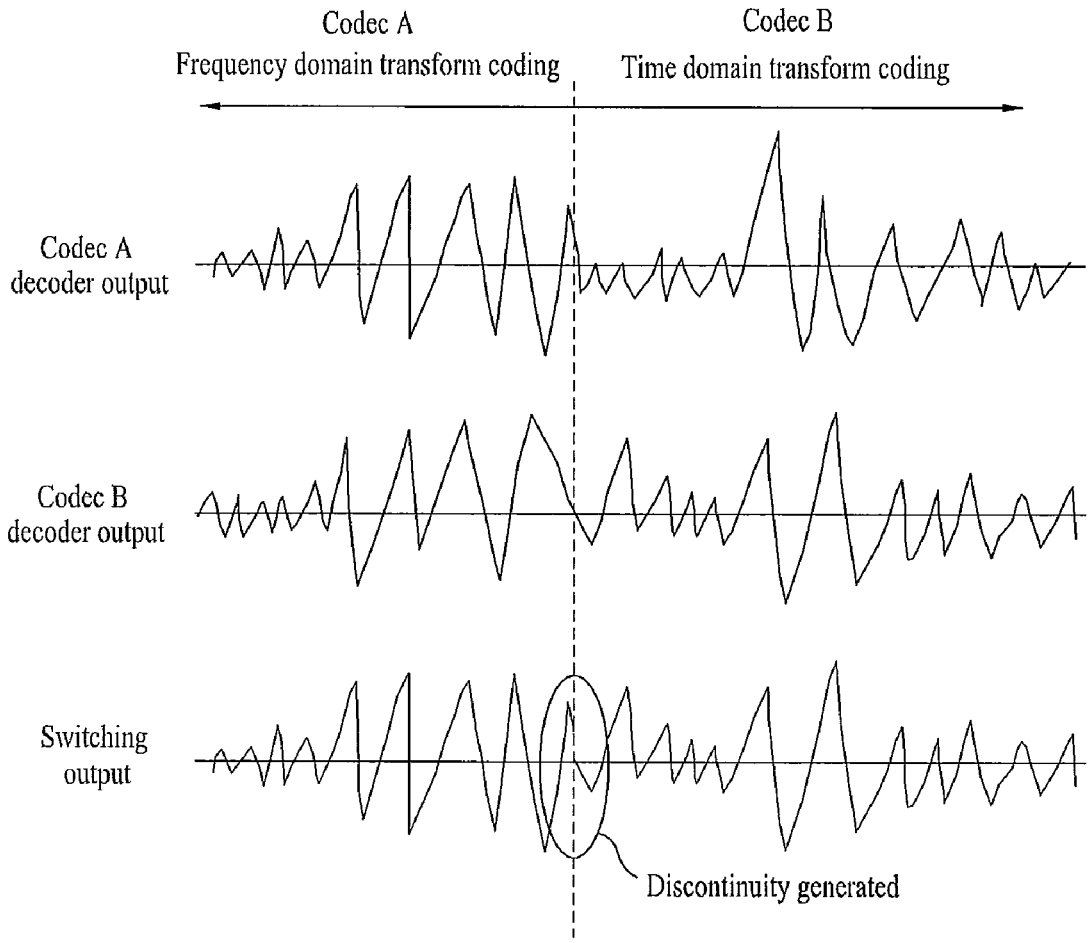
FIG. 8 and FIG. 9 are detailed diagrams for discontinuity occurrence in switching of a coding scheme.
Figure 9:
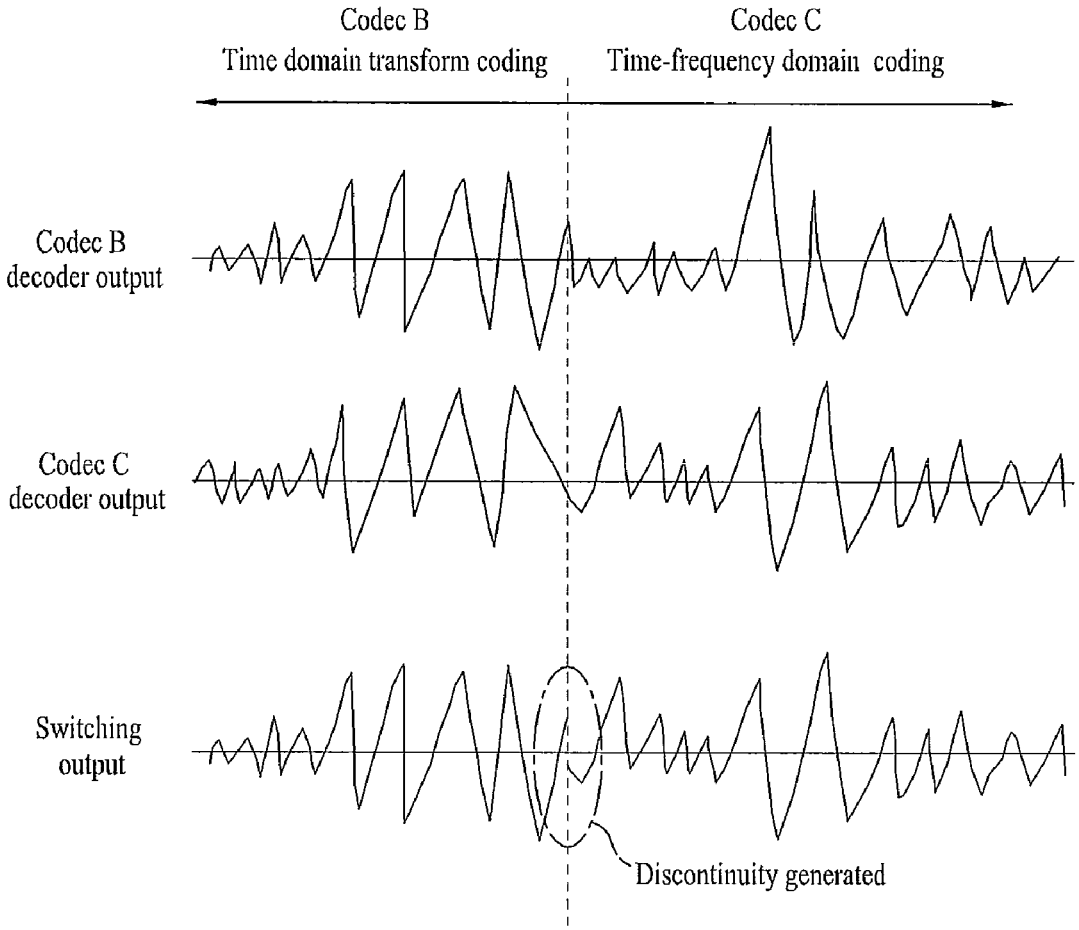
Figure 10:
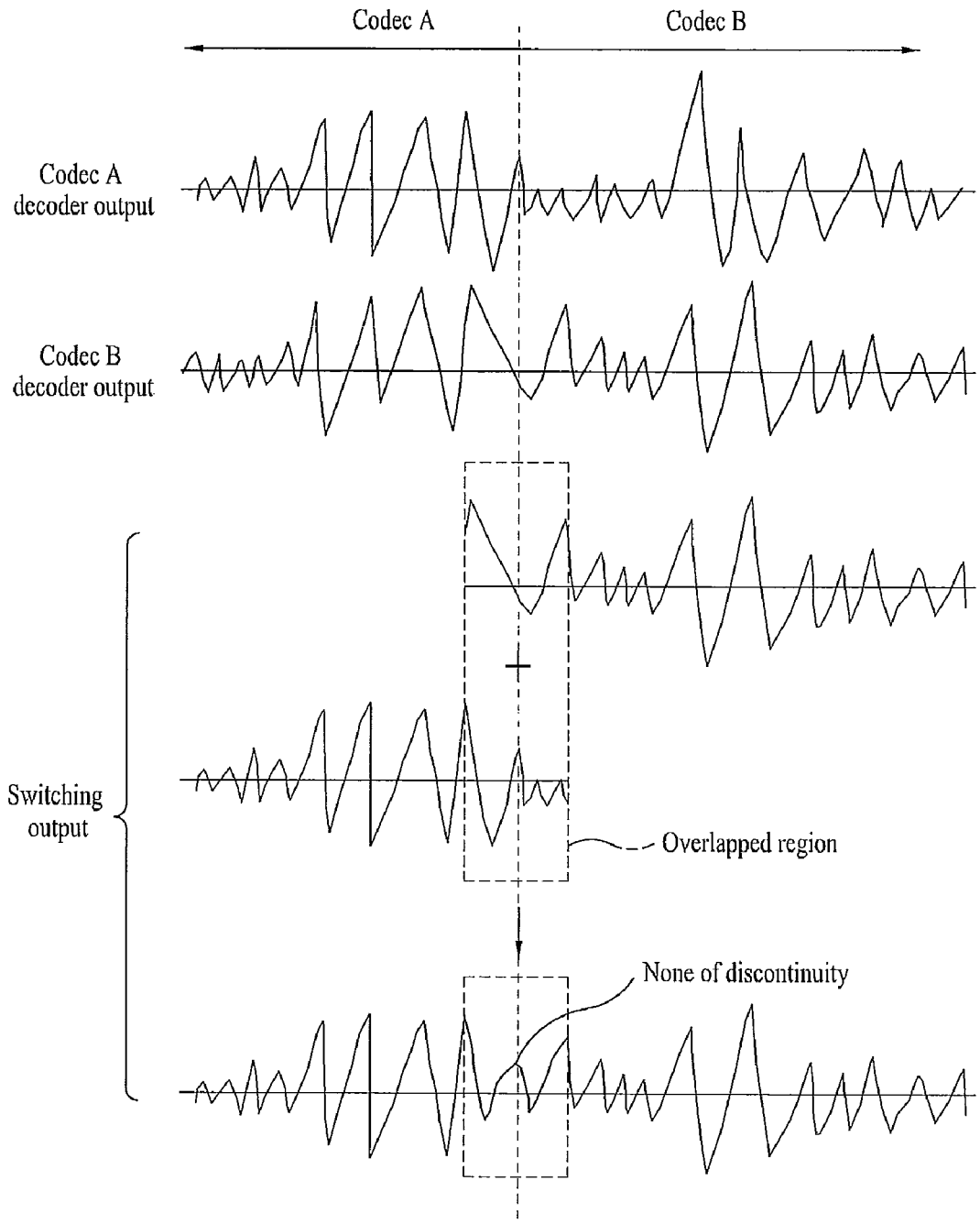
FIG. 10 is a diagram for an example of a method of preventing a discontinuity occurrence according to the present invention.

FIG. 8 and FIG. 9 are detailed diagrams for discontinuity occurrence in switching of a coding scheme, and FIG. 10 is a diagram for an example of a method of preventing a discontinuity occurrence according to the present invention.

Referring to FIG. 10, in order to prevent the generation of the discontinuity generated from the coding scheme switching, an output signal of each coding scheme is additionally included before and after the switching to generate a part where signals of two coding schemes are overlapped with each other. And, such a windowing job for overlapping processing as a hanning window function is performed on the signal overlapped part between the two coding schemes. Thus, it is able to prevent the discontinuity generation in the switching interval.

Yet, in order to use the two-signal-overlapped part for the windowing job, it is disadvantageous that encoding/decoding needs to be additionally performed as long as an overlapped length in consideration of the corresponding interval. Therefore, a method of overcoming this disadvantage and obtaining the overlapped part before and after the switching without using additional information on a bitstream is necessary. For this, it is able to use a method of generating a signal for the overlapped part using ZIR (zero input response) or reverberation filter and then combining the signal by overlapping.

Figure 11:
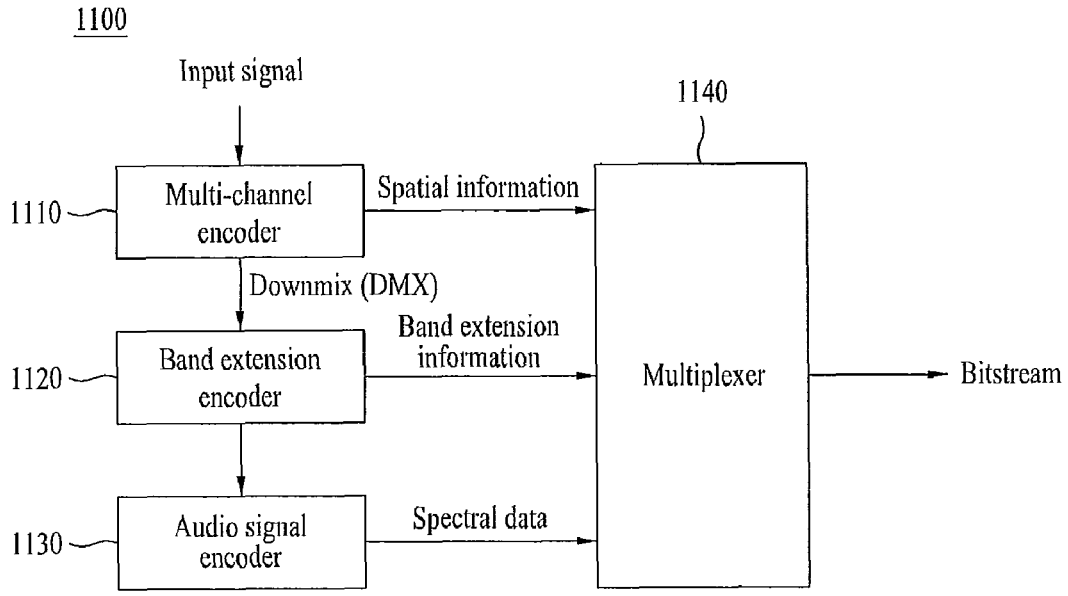
FIG. 11 is a block diagram for a first example (encoder) of an audio signal processing apparatus according to an embodiment of the present invention.

FIG. 11 is a block diagram for a first example (encoder) of an audio signal processing apparatus according to an embodiment of the present invention.

Referring to FIG. 11, an audio signal encoding apparatus 1100 includes a multi-channel encoder 1110, a band extension encoder 1120, an audio signal encoder 1130 and a multiplexer 1140.

First of all, the multi-channel encoder 1110 generates a mono or stereo downmix signal by receiving a signal on a plurality of channels (a signal on at least two channels) (hereinafter named a multi-channel signal) and then downmixing the received signal. The multi-channel encoder 1110 generates spatial information required for upmixing the downmix signal into a multi-channel signal. In this case, the spatial information can include channel level difference information, inter-channel correlation information, channel prediction coefficients, downmix gain information or the like. In case that the audio signal encoding apparatus 1100 receives a mono signal, the mono signal can bypass the multi-channel encoder 1110 without being downmixed.

The band extension encoder 1120 excludes spectral data of a partial band (e.g., high frequency band) of the downmix signal and is able to generate band extension information for reconstructing the excluded data.

The audio signal encoder 1130 obtains a characteristic of the downmix signal. If a specific frame or segment of the downmix signal has a large audio characteristic, the audio signal encoder 1130 encodes the downmix signal according to an audio coding scheme. If a specific frame or segment of the downmix signal has a large speech characteristic, the audio signal encoder 1130 encodes the downmix signal according to a speech coding scheme. As mentioned in the foregoing description with reference to FIG. 1, the downmix signal is encoded in a manner of determining whether to use a frequency domain transform coding scheme for a frame of an input signal by obtaining a characteristic of the input signal and then determining whether to perform a time domain transform coding or a time-frequency domain transform coding on a subframe constructing the frame of the input signal.

The multiplexer 1140 generates an audio signal bitstream by multiplexing spatial information, band extension information, spectral data and the like.

Meanwhile, the audio signal encoding apparatus can include a bitstream forming unit (not shown in the drawing). In this case, the bitstream forming unit adds flag information for a coding scheme used for the coding of the corresponding frame to information coded according to an optimal coding scheme based on the result of a sound activity detector (SAD). Flag information on a bitstream is obtained by the bitstream interpreter 360 of the decoding apparatus, as shown in FIG. 3, and the information on whether a bitstream corresponding to a current bitstream will be decoded using a prescribed coding scheme is then obtained.

Figure 12:
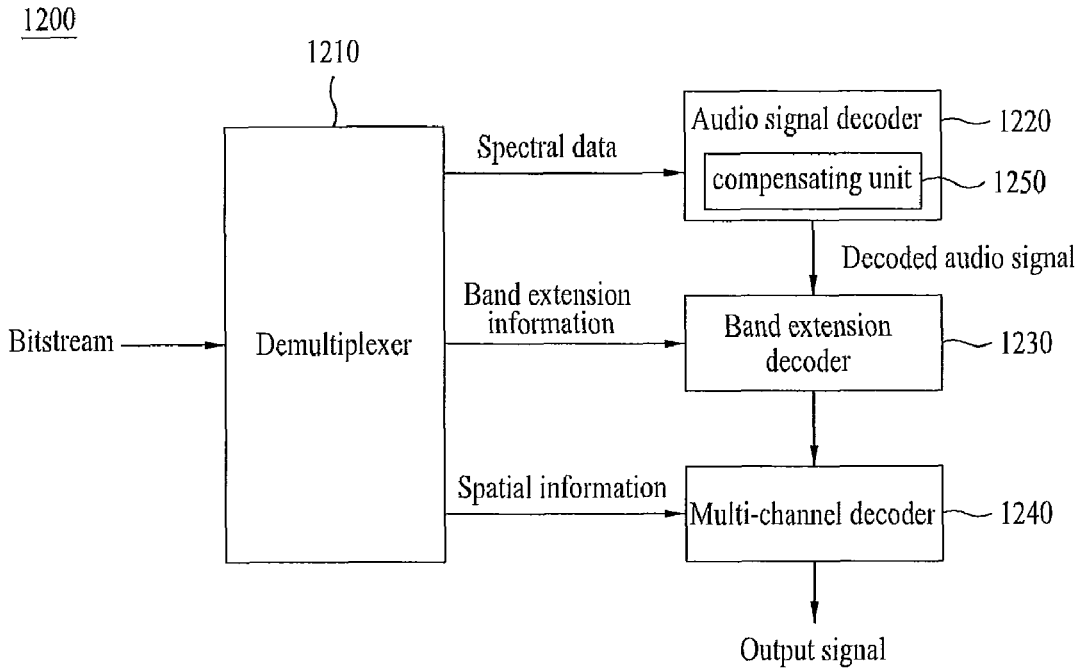
FIG. 12 is a block diagram for a second example (decoder) of an audio signal processing apparatus according to an embodiment of the present invention.

FIG. 12 is a block diagram for a second example (decoder) of an audio signal processing apparatus according to an embodiment of the present invention.

Referring to FIG. 12, an audio signal decoding apparatus 1200 can include a demultiplexer 1210, an audio signal decoder 1220, a band extension decoder 1230 and a multi-channel decoder 1240. Of course, the audio signal decoder 1229 can further include a compensating unit 1250 according to an embodiment of the present invention.

The demultiplexer 1210 extracts spectral data, band extension information, spatial information and the like from an audio signal bitstream. The audio signal decoder 1220 decodes the spectral data by an audio coding scheme if the spectral data corresponding to a downmix signal has a large audio characteristic. The audio signal decoder 1220 includes a decoding unit (a) receiving a plurality of frame data including first frame data and second frame data encoded by at least one coding schemes, (b) obtaining first flag information indicating whether the first frame data and the second frame data are encoded by frequency domain transform coding scheme, respectively, (c) decoding the first frame data by frequency domain transform coding scheme based on the first flag information when the first frame data is encoded by frequency domain transform coding scheme, (d) obtaining second flag information indicating whether subframe data is encoded by time domain transform coding scheme or time-frequency domain coding scheme when the second frame data is not encoded by frequency domain transform coding scheme, the at least two subframe data being included in the second frame data and (e) decoding the subframe data by time domain transform coding scheme or time-frequency domain transform coding scheme based on the second flag information, and a compensating unit compensating for discontinuity existing between the first frame data decoded by frequency domain transform coding scheme and the subframe data decoded by time domain transform coding scheme, wherein the time-frequency domain coding scheme is time domain coding scheme including frequency domain transform.

The band extension decoder 1230 decodes a band extension information bitstream and then generates an audio signal (or, spectral data) of another band (e.g., high frequency band) from a portion or all of the audio signal (or, spectral data) using this information.

If the decoded audio signal is a downmix, the multi-channel decoder 1240 generates an output channel signal of a multi-channel signal (stereo signal included) using the spatial information.

The audio signal decoder including the discontinuity compensating unit 1250 of the present invention is available for various products to use. Theses products can be grouped into a stand alone group and a portable group. A TV, a monitor, a settop box and the like belong to the stand alone group. And, a PMP, a mobile phone, a navigation system and the like belong to the portable group.

Figure 13:
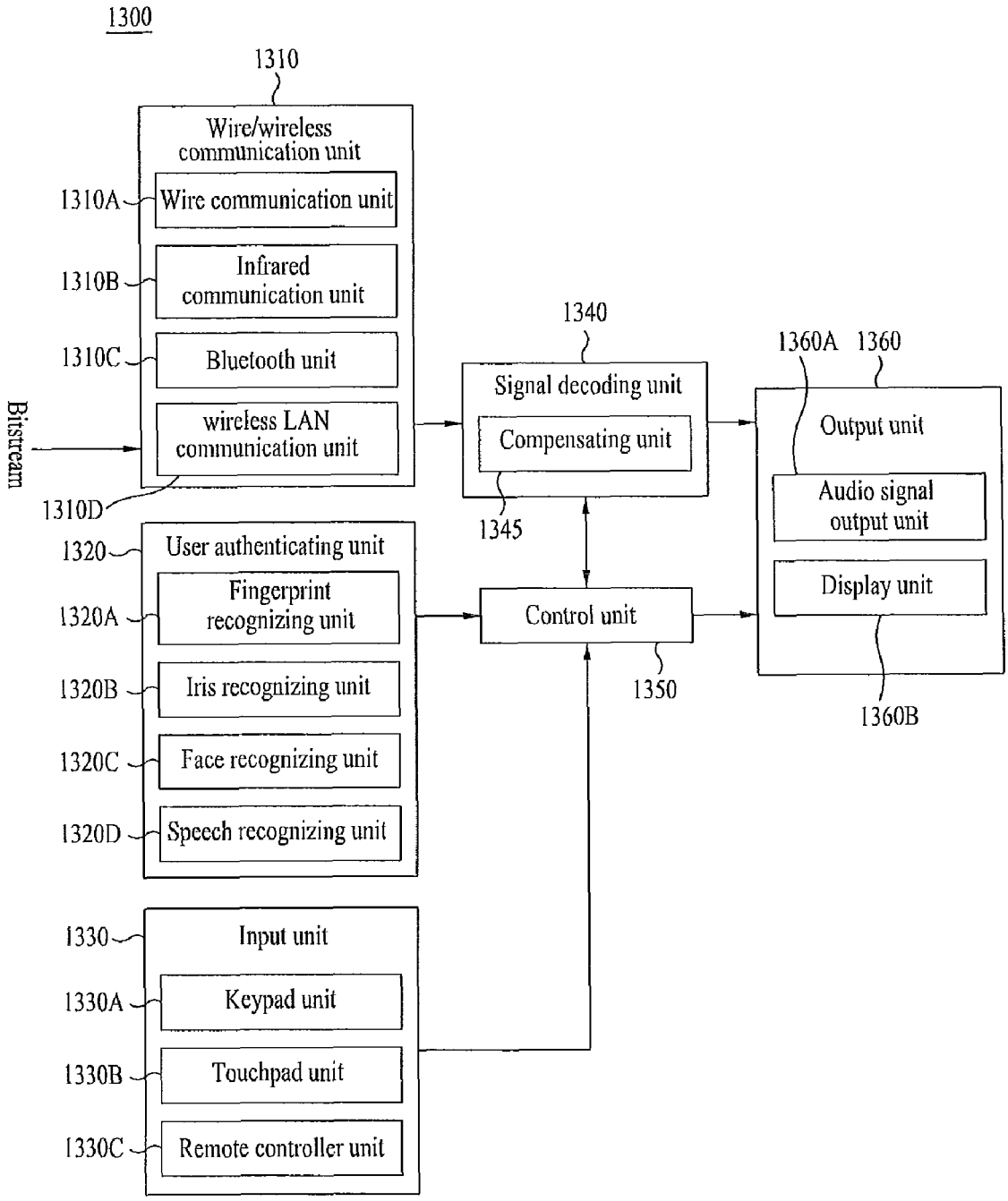
FIG. 13 is a block diagram of a product in which a decoder including a compensating unit according to an embodiment of the present invention is implemented.
Figure 14:
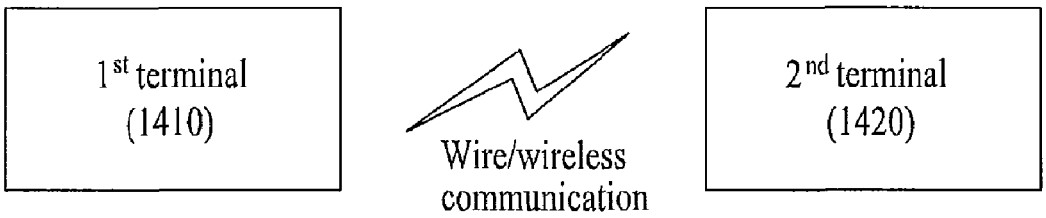
FIG. 14 is a diagram for relations between products in which a decoder including a compensating unit according to an embodiment of the present invention is implemented.
Figure 14:
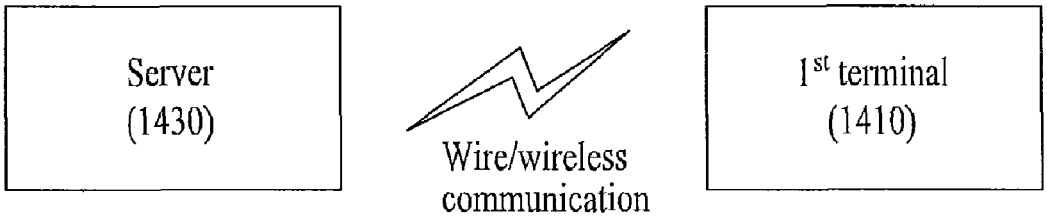

FIG. 13 is a block diagram of a product in which a decoder including a compensating unit according to an embodiment of the present invention is implemented, and FIG. 14 is a diagram for relations between products in which a decoder including a compensating unit according to an embodiment of the present invention is implemented.

Referring to FIG. 13, a wire/wireless communication unit 1310 receives a bitstream via wire/wireless communication system. In particular, the wire/wireless communication unit 1310 can include at least one of a wire communication unit 1310A, an infrared communication unit 1310B, a Bluetooth unit 1310C and a wireless LAN communication unit 1310D.

A user authenticating unit 1320 receives an input of user information and then performs user authentication. The user authenticating unit 1320 can include at least one of a fingerprint recognizing unit 1320A, an iris recognizing unit 1320B, a face recognizing unit 1320C and a speech recognizing unit 1320D. The fingerprint recognizing unit 1320A, the iris recognizing unit 1320B, the face recognizing unit 1320C and the speech recognizing unit 1320D receives fingerprint information, iris information, face contour information and speech information and then convert them into user informations, respectively. Whether each of the user informations matches pre-registered user data is determined to perform user authentication.

An input unit 1330 is an input device enabling a user to input various kinds of commands and can include at least one of a keypad unit 1330A, a touchpad unit 1330B, a remote controller unit 1330C, by which the present invention is non-limited.

A signal decoding unit 1340 includes a compensating unit 145. As mentioned in the foregoing description with reference to FIG. 3, the compensating unit 1345 compensates for discontinuity occurring in case of a coding scheme switching between a frequency domain transform coding and a time domain transform coding.

A control unit 1350 receives input signals from input devices and controls all processes of the signal decoding unit 1340 and an output unit 1360. In particular, the output unit 160 is an element configured to output an output signal generated by the signal decoding unit 1340 and the like and can include a speaker unit 1360A and a display unit 1360B. If the output signal is an audio signal, it is outputted to a speaker. If the output signal is a video signal, it is outputted via a display.

FIG. 14 shows the relation between the terminal corresponding to the product shown in FIG. 13 and a server.

Referring to FIG. 14*a*, it can be observed that a first terminal 1410 and a second terminal 1420 can exchange data or bitstreams bi-directionally with each other via the wire/wireless communications units.

Referring to FIG. 14*b*, it can be observed that a server 1430 and a first terminal 1410 can perform wire/wireless communication with each other.

An audio signal processing method according to the present invention can be implemented into a computer-executable program and can be stored in a computer-readable recording medium. And, multimedia data having a data structure of the present invention can be stored in the computer-readable recording medium. The computer-readable media include all kinds of recording devices in which data readable by a computer system are stored. The computer-readable media include ROM, RAM, CD-ROM, magnetic tapes, floppy discs, optical data storage devices, and the like for example and also include carrier-wave type implementations (e.g., transmission via Internet). And, a bitstream generated by the above encoding method can be stored in the computer-readable recording medium or can be transmitted via wire/wireless communication network.

Accordingly, the present invention is applicable to audio signal encoding and decoding.

An audio signal processing method according to the present invention can be implemented into a computer-executable program and can be stored in a computer-readable recording medium. And, multimedia data having a data structure of the present invention can be stored in the computer-readable recording medium. The computer-readable media include all kinds of recording devices in which data readable by a computer system are stored. The computer-readable media includes ROM, CD-ROM, magnetic tapes, floppy discs, optical data storage devices, and the like for example. And, a bitstream generated by the above encoding method can be stored in the computer-readable recording medium.

What is claimed is:

1. A method for processing an audio signal, comprising:

receiving a plurality of frame data including first frame data and second frame data encoded by at least one coding scheme;

obtaining first flag information indicating whether the first frame data and the second frame data are encoded by a frequency domain transform coding scheme, respectively;

decoding the first frame data by the frequency domain transform coding scheme based on the first flag information when the first frame data is encoded by the frequency domain transform coding scheme;

obtaining second flag information indicating whether at least two subframe data are encoded by a time domain transform coding scheme or a time-frequency domain coding scheme when the second frame data is not encoded by the frequency domain transform coding scheme, the at least two subframe data being included in the second frame data;

decoding the subframe data by the time domain transform coding scheme or a time-frequency domain transform coding scheme based on the second flag information; and compensating for discontinuity existing between the first frame data decoded by the frequency domain transform coding scheme and the subframe data decoded by the time domain transform coding scheme, wherein the time-frequency domain coding scheme is a time domain coding scheme including a frequency domain transform.

2. The method of claim 1, further comprising:

compensating for discontinuity existing between the subframe data decoded by the time domain transform coding scheme and the subframe data decoded by time frequency the time-frequency domain transform coding scheme.

3. The method of claim 1 or 2, wherein the compensating step is performed using at least one selected from the group consisting of smoothing, ZIR (Zero Input Response) and reverberation filter.

4. The method of claim 1, wherein the frame data and the subframe data decoding steps include the step of compensating for a delay between the frame data and between the subframe data.

5. The method of claim 1, the compensating for discontinuity further comprising:

decoding a subframe data including the discontinuity by using the frequency domain transform coding scheme and the time domain transform coding scheme, respectively.

6. The method of claim 5, further comprising:

concatenating a portion of the subframe data decoded by the frequency domain transform coding scheme corresponding to in front of the discontinuity and a portion of the subframe data decoded by the time domain transform coding scheme corresponding to the next of the discontinuity.

7. The method of claim 5, further comprising:

processing the subframe data decoded by the frequency domain transform coding scheme and the subframe data decoded by the time domain transform coding scheme by using a harming window function.

8. An apparatus for processing an audio signal comprising:

a decoding unit configured to (a) receive a plurality of frame data including first frame data and second frame data encoded by at least one coding scheme, (b) obtain first flag information indicating whether the first frame data and the second frame data are encoded by a frequency domain transform coding scheme, respectively, (c) decode the first frame data by the frequency domain transform coding scheme based on the first flag information when the first frame data is encoded by the frequency domain transform coding scheme, (d) obtain second flag information indicating whether at least two subframe data are encoded by a time domain transform coding scheme or a time-frequency domain coding scheme when the second frame data is not encoded by the frequency domain transform coding scheme, the at least two subframe data being included in the second frame data, and (e) decode the subframe data by the time domain transform coding scheme or a time-frequency domain transform coding scheme based on the second flag information; and a compensating unit configured to compensate for discontinuity existing between the first frame data decoded by the frequency domain transform coding scheme and the subframe data decoded by the time domain transform coding scheme, wherein the time-frequency domain coding scheme is a time domain coding scheme including a frequency domain transform.

9. The apparatus of claim 8, wherein the compensating unit is further configured to compensate for discontinuity existing between the subframe data decoded by the time domain transform coding scheme and the subframe data decoded by the time-frequency domain transform coding scheme.

10. The apparatus of claim 8 or 9, wherein the compensating unit is further configured to compensate using at least one selected from the group consisting of smoothing, ZIR (Zero Input Response) and reverberation filter.

11. The apparatus of claim 8, wherein the decoding of the frame data and the subframe data further includes compensating for a delay between the frame data and between the subframe data.

12. The apparatus of claim 8, wherein the compensating unit is further configured to decode a subframe data including the discontinuity by using the frequency domain transform coding scheme and the time domain transform coding scheme, respectively.

13. The apparatus of claim 12, wherein the compensating unit is further configured to further concatenate a portion of the subframe data decoded by the frequency domain transform coding scheme corresponding to in front of the discontinuity and a portion of the subframe data decoded by the time domain transform coding scheme corresponding to the next of the discontinuity.

14. The apparatus of claim 12, wherein the compensating unit is further configured to further process the subframe data decoded by the frequency domain transform coding scheme and the subframe data decoded by the time domain transform coding scheme by using a hanning window function.

15. A computer-readable storage medium, comprising a non-transitory medium including at least one of ROM, a CD-ROM, magnetic tapes, floppy discs, and optical data storage devices, comprising digital audio data stored therein, the digital audio data comprising:

a plurality of frame data including first frame data and second frame data encoded by at least one coding scheme;

first flag information indicating whether each of the first frame data and the second frame data is encoded by a frequency domain transform coding scheme; and second flag information indicating whether at least two subframe data are encoded by a time domain transform coding scheme or a time-frequency domain coding scheme when the second frame data is not encoded by the frequency domain transform coding scheme, the at least two subframe data being included in the second frame data, wherein the time-frequency domain coding scheme is time a time domain coding scheme including a frequency domain transform, and wherein the first frame data is decoded by the frequency domain transform coding scheme based on the first flag information when the first frame data is encoded by the frequency domain transform coding scheme, and the subframe data is decoded by the time domain transform coding scheme or a time-frequency domain transform coding scheme based on the second flag information, and the digital audio data is compensated for discontinuity existing between the first frame data decoded by the frequency domain transform coding scheme and the subframe data decoded by the time domain transform coding scheme.

16. The computer-readable storage medium of claim 15, the compensating for discontinuity further comprising:

decoding a subframe data including the discontinuity by using the frequency domain transform coding scheme and the time domain transform coding scheme, respectively.

17. The computer-readable storage medium of claim 16, further comprising:

concatenating a portion of the subframe data decoded by the frequency domain transform coding scheme corresponding to in front of the discontinuity and a portion of the subframe data decoded by the time domain transform coding scheme corresponding to the next of the discontinuity.

18. The computer-readable storage medium of claim 16, further comprising:

processing the subframe data decoded by the frequency domain transform coding scheme and the subframe data decoded by the time domain transform coding scheme by using a hanning window function.

* * * * *